US009314668B2

(12) United States Patent
Hanks et al.

(10) Patent No.: US 9,314,668 B2
(45) Date of Patent: Apr. 19, 2016

(54) RANGE OF MOTION EXERCISER

(71) Applicants: Richard Hanks, Swansea, MA (US); John Seguin, Canton, MA (US)

(72) Inventors: Richard Hanks, Swansea, MA (US); John Seguin, Canton, MA (US)

( * ) Notice: Subject to any disclaimer, the term of this patent is extended or adjusted under 35 U.S.C. 154(b) by 0 days.

(21) Appl. No.: 14/549,753

(22) Filed: Nov. 21, 2014

(65) Prior Publication Data

US 2015/0148196 A1 May 28, 2015

Related U.S. Application Data

(60) Provisional application No. 61/908,310, filed on Nov. 25, 2013.

(51) Int. Cl.
*A63B 24/00* (2006.01)
*A63B 23/16* (2006.01)

(52) U.S. Cl.
CPC ..... *A63B 24/0087* (2013.01); *A63B 23/16* (2013.01)

(58) Field of Classification Search
CPC .... A63B 24/00; A63B 2225/62; A63B 41/00; A63B 24/0062; A63B 24/0087; A63B 23/16
See application file for complete search history.

(56) References Cited

U.S. PATENT DOCUMENTS

| | | | | | |
|---|---|---|---|---|---|
| 5,690,586 | A * | 11/1997 | Wilhelm | A63B 23/16 | 482/105 |
| 2007/0015645 | A1* | 1/2007 | Hale | A63B 21/143 | 482/140 |
| 2007/0087901 | A1* | 4/2007 | Brassil | A63B 21/1449 | 482/44 |
| 2011/0237403 | A1* | 9/2011 | Huber | A63B 22/0605 | 482/57 |
| 2013/0130871 | A1* | 5/2013 | McCoy | A63B 23/20 | 482/113 |

* cited by examiner

*Primary Examiner* — Glenn Richman
(74) *Attorney, Agent, or Firm* — Fish & Richardson P.C.

(57) ABSTRACT

A system includes a device that includes one or more bladders capable of being inflated and deflated. The system also includes an information package capable of processing data representing the inflating and deflating of the one or more bladders.

7 Claims, 13 Drawing Sheets

RANGE OF MOTION EXERCISER

CLAIM OF PRIORITY

This application claims priority under 35 USC §119(e) to U.S. Patent Application Ser. No. 61/908,310, filed on Nov. 25, 2013, the entire contents of which are hereby incorporated by reference.

TECHNICAL FIELD

This disclosure relates to exercise equipment, and more particularly to range of motion exercise equipment.

BACKGROUND

Various types of afflictions such as diseases (i.e., stroke, rheumatoid arthritis), deformities, injuries, etc. can rob individuals of their physical abilities and in some cases their ability to be independent. The medical profession has researched and developed treatments over the years to aid such individuals during their recovery from such afflictions or in some cases simply learning to live with them. Affected individuals may find comfort from treatments involving massage, applying heat, along with other healing techniques to bring relief. However, the severity of some disorders may call for more invasive treatments such as surgery, proscribing drugs, etc. that further extend recovery periods.

SUMMARY

A cost effective therapeutic exercise system may aid the recovery of individual suffering from conditions such as arthritis, carpal tunnel syndrome as well as other types of afflictions that limit physical function. Along with providing relief, the system and its components may be utilized in other applications such as strength training and other types of activities including preventive activities.

In one aspect, a system includes a device that includes one or more bladders capable of being inflated and deflated. The system also includes an information package capable of processing data representing the inflating and deflating of the one or more bladders.

Implementations may include one or more of the following features. The one or more bladders may be shaped for being received by a palm of a hand. The one or more bladders may be capable of being inflated and deflated in a repetitive manner for exercising phalanges. The system may include one or more components for controlling the inflating and deflating of the one or more bladders. The one or more components for controlling the inflating and deflating of the one or more bladders may be located remote from the device. The one or more components for controlling the inflating and deflating of the one or more bladders may be located near the device. The system may include a heat controller to control the operating temperature of the device. The one or more bladders may be fluid filled. The system may include one or more communication components capable of transmitting data from the information package to a remote location. The one or more communication components may be capable of receiving data for controlling the operations of the device.

The details of one or more embodiments of the disclosure are set forth in the accompanying drawings and the description below. Other features, objects, and advantages of the disclosure will be apparent from the description and drawings, and from the claims.

DESCRIPTION OF DRAWINGS

Like reference symbols in the various drawings indicate like elements.

DETAILED DESCRIPTION

In general, one or more medical treatment systems may include a device capable of allowing an individual to execute therapeutic exercises that may aid in recovery from an injury or illness, assist in strength training, etc. by improving the individual's movement, range of motion, etc. for a variety of body parts (e.g., hands, fingers, legs, neck, etc.). The device may be used for a variety of afflictions including carpal tunnel syndrome and arthritis, as well as stroke. For example, many individuals who suffer a stroke, for example, may have their hand(s) clenched to some extent for long periods of time, making it difficult and painful to open the hand(s) and extend the fingers. Such a device may also be employed for applications such as strength training for individuals, including athletes, who have injured an extremity or body part that has impacted their range of motion and/or normal strength. Other applications may be found in other medical arenas along with industrial and other types of arenas whereby a desired and defined range of movement or static positioning can be redefined and achieved through utilization of the device (e.g., remote appliance diagnostics). Along with being designed for any individual, in some arrangement the device design may be focused for a particular type of individual. For example, particular body parts that are used more naturally by individuals (e.g., a left-handed person, a right-handed person, etc.). Devices may also be designed for individuals of any age (e.g., infants born with physical deformities, individuals who suffer from stroke or other debilitating conditions, elderly individuals, etc.). The device may also be gender-specific (e.g., male or female) or gender independent. In some arrangements, the device design may be driven for use by non-humans, for example, a device may be adapted for the treatment of particular animals, a range of animal types, etc.

Figure 1:
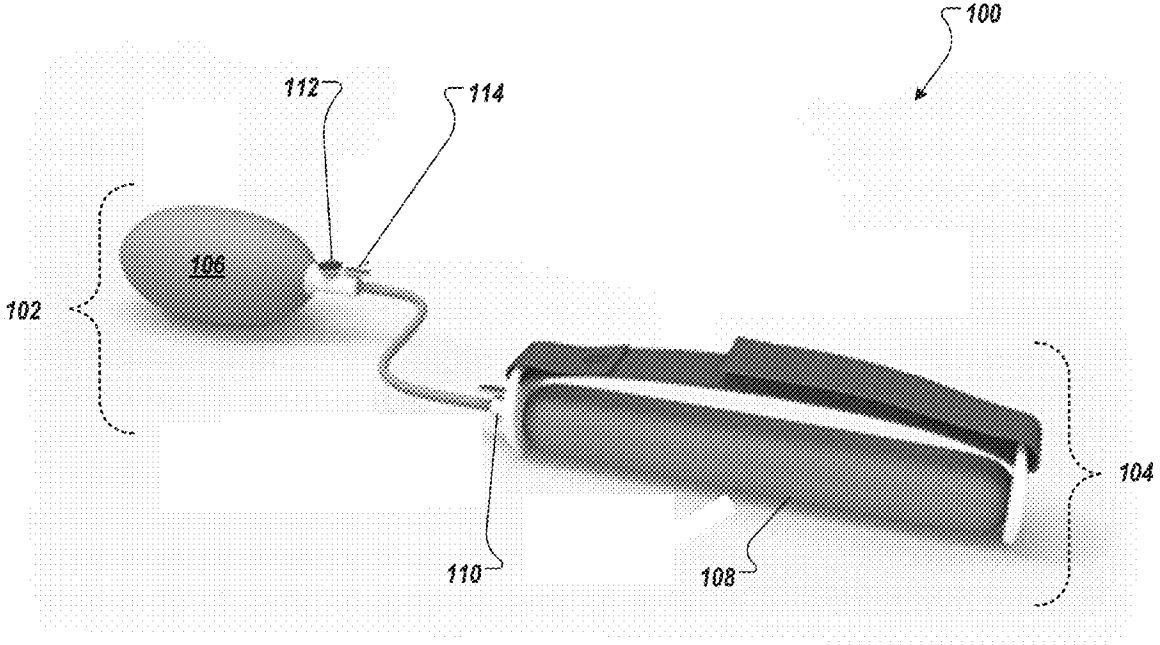
FIGS. 1-5 illustrate a hand and finger exercise device.

Referring to FIG. 1, an example range of motion exercising device 100 is presented for use in exercising an individual's hand. The device 100 includes an air supplier 102 that provides air to an exerciser 104 capable of interacting with a user. In this arrangement, the air supplier 102 includes a pump 106 that is capable of providing air to an inflatable bladder 108 included exerciser 104. The bladder 108 may be produced (e.g., contoured) to be easily received by a body part, region of a body for a desired therapeutic range of motion, positioning, and/or resistance. For example, the bladder 108 may be designed to be received by the palm of the hand even if the hand is clenched (e.g., due to stroke). In some arrangements, the bladder 108 may be contoured to a specific extremity to achieve a prescribed range of exercise intensity. Design parameters of exercisers, along with characteristics and properties, may be adjusted for different applications, therapeutic progression, required range of movement for static applications, etc. For example, bladders may be designed of any shape and may employ one or more geometries of various sizes. One or more materials may be utilized in bladder construction, and the materials may exhibit a variety of properties. For example, properties that address material strength, texture, flexibility, water-resistance, etc. may be employed. In some arrangements, the bladder may include combinations of synthetic and natural materials that are flexible, durable, and washable. To improve durability, one or more sleeves may be designed for fitting over the bladder 108. Such a sleeve may include a soft and flexible cover material (synthetic or natural) that is able to stretch over the bladder. Along with being removable, the sleeve also may be machine-washable. Bladder design, along with other portions of the device, may be designed for the general population, for particular segments of the population based upon one or more demographics (e.g., infants, the elderly, etc.), for example.

Properties of the device 100, components of the device such as the exerciser 104, etc. may be customized for environmental variants as to further adapt to medical, industrial, entertainment-based, and other types of applications, where movement and/or static positioning of a body part may be beneficial. In the illustrated example, the air supplier 106 and the exerciser 108 provide a means of exercising the phalanges of an individual's hand by allowing for extension of some or all phalanges in a manner that can be considered both comfortable and effective for patients who are unable to physically exercise their hands under their own power. In general, to perform the exercises, the pump 106 is operated (e.g., the bulb-shaped air reservoir is squeezed) to inflate the bladder 108 for the purpose of changing the position of the target body part (e.g., straightening out the phalanges from a clenched fist). The exercise motion provided by inflating the bladder 108 can be is performed in a repetitive manner (e.g., inflating and deflating repetitively to cycle the position of the phalanges between a clenched position and a straightened position). Through this operation of the device 100, a user is enabled to manually execute a therapeutic exercise of a defined body part through the use of air pressure that opens or expands the body part to a desired range, and then closes with gentle but firm air pressure. Manual interaction would be needed in the illustrated example to allow the pump 106 to inflate the bladder 108; however one or more automatic techniques may be implemented to reduce or even remove the need for such manual interaction (e.g., provided by a healthcare worker) to execute an exercise. For example, one or more components may be included in the device 100 for controlling functions associated with the device such as controlling operations of the air supplier 102 (e.g., the pump 106). In one arrangement, such controlling components may be located on the device 100; however such components may also be located separate from the device. Such components may also be located in a distributed manner on-board the device and off-board the device. As such, control of the device may be provided from local, remote, or both local and remote components. Based on the ability to be remotely controlled, individuals (e.g., patients) who may have difficulty visiting their healthcare providers (e.g., reside in rural areas) may be able to remotely receive their treatments. For example, one or more communication systems (e.g., telephone networks, computer networks such as the Internet, etc.) may be employed for controlling the device. For example, data (e.g., commands) may be sent from a remotely located control center to the device. Along with sending data to devices, information may also be received from the device. For example, operational information (e.g., data representing periods of inflation, periods of deflation, etc.) may be sent from the device. Data received from the device may also reflect other situations (e.g., a patient may have overridden a remotely provided instruction to the device due to discomfort, complication, etc., for example, to reflect the patient is not adhering to a rehabilitation regiment). This provided information may be utilized in a variety of applications, for example, to monitor and analyze treatments of individuals, operations of the device, etc. In the case of industrial and/or appliance-based applications, equipment of all sizes, complexity, and precision tolerances can be pre-configured with the device 100 to achieve remote diagnostics—and to repair in instances where such movement may rectify an issue, achieve a desired outcome, or allow access for reconfiguration or repair. In some arrangements, thin applications may be developed on the client/device side to address (e.g., use) the captured, analyzed, etc. data.

In the illustrated example, the device 100 is specifically designed to allow the user to set the degree of inflation according to comfort, physician-recommended level of therapy and/or exercise, etc. to achieve a range of movement or positions (for static applications). To assist with operations, additional components may be incorporated into the device 100. For example, a safety release valve 110 may be included to regulate the pressure within the bladder 108 (e.g., so as not to exceed a predefined pounds-per-square-inch (PSI) threshold). To assist with the inflating, deflating, etc. of the bladder 104, a pressure gauge 112 may be incorporated into the device 100 (e.g., connected to the pump 106 as illustrated) along with an air release value 114 (e.g., also connected to the pump). Other types of components may be incorporated into the device.

In general, the inflatable exerciser 108 is pliable yet firm enough to supply the necessary pressure for physical therapy—and also can be separated from the pump 106 to be held in place at the desired degree of inflation for both maximum comfort and therapeutic value, or a defined range of movement to achieve a desired positioning. The pump 106 of the device 100 can be manually operated, dynamically adjusted, pre-set remotely, etc. to a desired degree of inflation. The pump 106 can then either be detached or deactivated while keeping the desired range in place, while the individual peruses another activity (e.g., watching television). The pump 106 can come in various sizes and shapes, depending on the needs of the user (i.e., adult, child applications). Additional features may be included in the air supplier 102, for example, the pump may be electrically-powered (e.g., battery operated) to allow for automatic operation or to assist manual operations of an individual. Along with automatic operation, operations of the device 100 may be programmed (e.g., from a remote location such as a healthcare center) to provide increased flexibility and breadth. In the case of a healthcare provider (i.e., physical therapist) who wishes to set up a specific set of exercises and then monitor their patient's progress, the intensity of exercise could increase or decrease depending upon the patient's unique progress. For a static application, such progress would be monitored via a predefined progression for that specific application.

Other components may be included in the air supplier 102 to provide additional capabilities, for example a heating source, heat exchanger, etc. may be included for temperature control. In some arrangements, the heating source may be incorporated into the pump, tubing that provides the air from the pump, the bladder, etc. For example, one or more electrodes may be encased around the pump and the tubing to a release terminal. A sleeve may also wrap the bladder and provide heat as provided from by an energy source (e.g., battery). Heating elements may also be incorporated into the bladder. In the illustrated arrangement, air is provided by the pump 106 to the exerciser 104, however, other types of fluids may be utilized, e.g., one or more liquids may be used for inflating the bladder 108 for heating, cooling, measurement purposes, etc.

To control the flow of information to the device 100 (e.g., programmable commands from a remote location) and/or from the device (e.g., sending measurement data to a remote location), one or more measurement, communication techniques, etc. may be implemented. For example, a variety of communication components (e.g., sensors, wireless transmitters, receivers, transceivers, etc.) may be incorporated into the device 100. Such capabilities may allow the device 100 to accept remote instruction and communication, as well as report back on the progression and/or status (e.g., metrics) of the respective individual. The two-way communication between a healthcare worker (e.g., primary care physician, surgeon, physical therapist, a responsible technical person such as an engineer, etc.) and a patient (or an application) may include a reporting feature that allows the healthcare worker the ability to capture and analyze data in order to review and assess a patient's progress, and to diagnose or report on that progress while adjusting the exercise program and/or applicable settings accordingly.

By allowing the device 100 to provide information to one or more remote locations, healthcare workers can be provided the ability to assess data (e.g., real-time data, previously stored data, etc.) pertaining to the patient, one or more conditions (e.g., a target condition), progression, environmental changes, a pre-defined tolerance (e.g., that allows for necessary modifications) etc. Such data communication capabilities may provide various advantages such as assisting individuals residing at relatively remote locations (e.g., a rural setting that does not generally easy access to healthcare, where healthcare workers are unable to make onsite visits but where remote communication capabilities are available, etc.). Provided this communication capability, programming of device operations may be dynamically adjusted based upon information received from the device (e.g., measurement exercises, parameters from a local on-device application, etc.) or other information sources (e.g., a pre-defined outcome desired by the healthcare worker). Examples include devices such as breathing machines that dynamically set air flow intensity through on-board breathing measurements.

Figure 2:
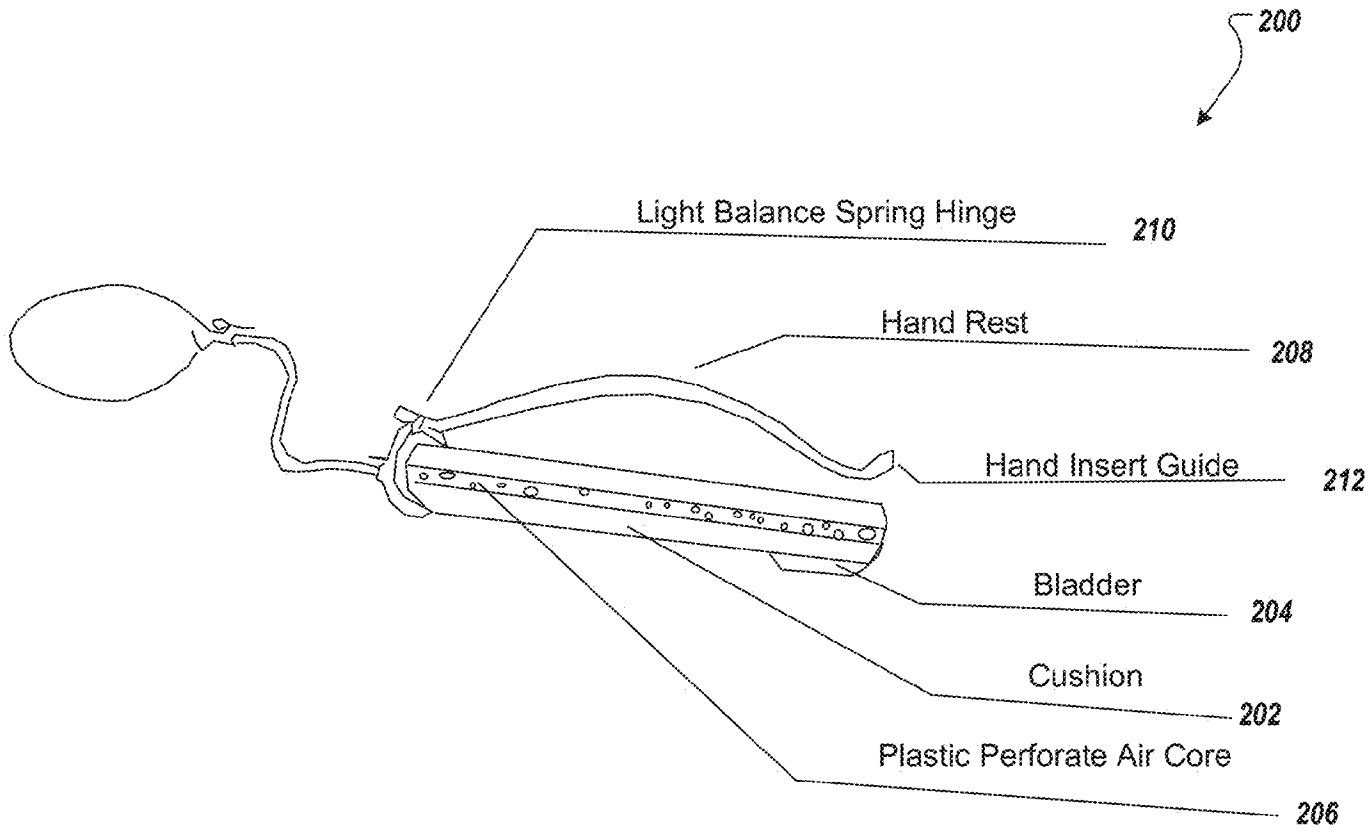

Referring to FIG. 2 a device 200 is presented that represents a variant of the device 100 presented in FIG. 1. While various design changes and adjustments may be implemented; the device 200 incorporates a cushion 202 into a bladder 204 to improve user comfort. To receive the air from a pump, the device also includes a core 204 that may be produced from one or more materials. For example, a plastic material may be used to produce a perforated air core 206. The device 200 also includes a mechanism for assisting the patient with holding the device during exercise sessions. Similar to the detachable hand strap included in the device 100, the presented device 200 also includes a hand rest 208 that is connected to the bladder with a light balance spring hinge 210. However, other types of connecting mechanisms may be employed for connecting the hand rest 208. To assist the user with physically engaging the device, one end of the hand rest 208 also includes a mechanical hand insert guide 212. Other guide techniques that may be mechanical-based, visually based (e.g., that provide one or more visual signals), audio based (e.g., that provide one or more tones to alert a user), etc. may be used individually or in concert.

Figure 3:
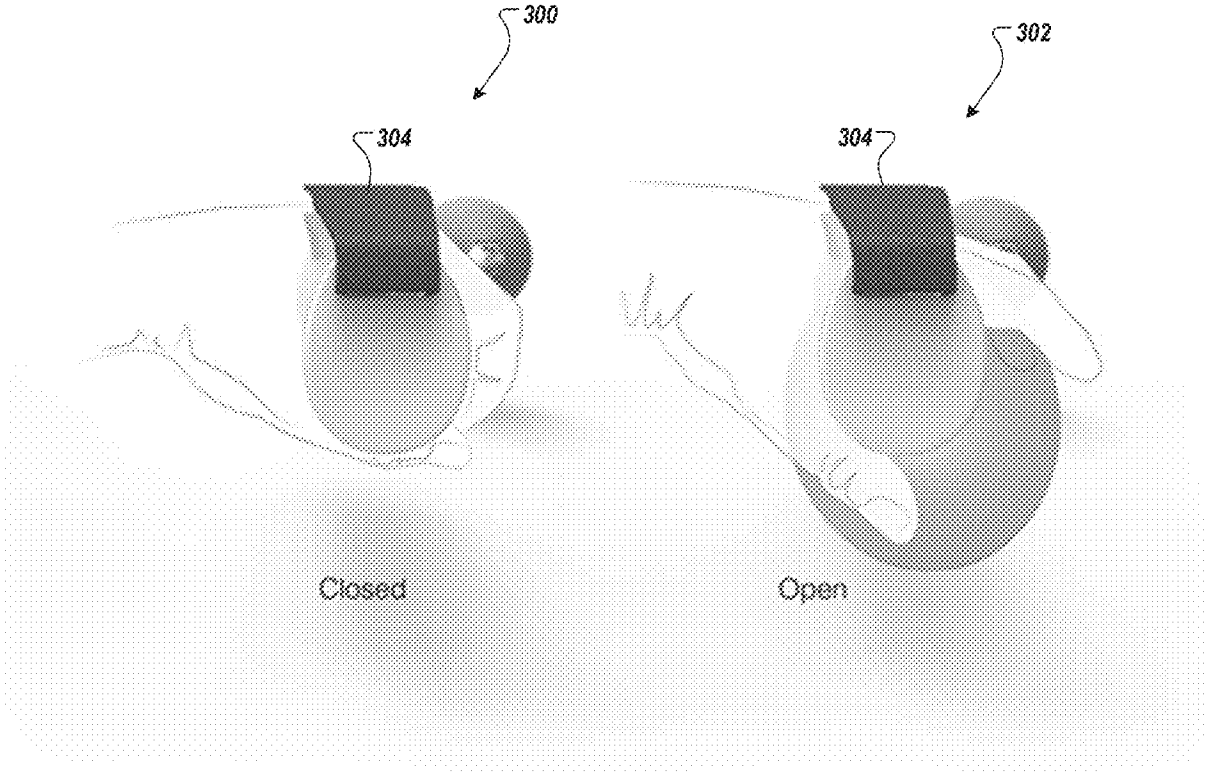

Referring to FIG. 3, two perspective views 300, 302 are presented that illustrate an exerciser 304 in operation with and without the bladder being pressurized. In particular, view 300 represents when a patient's hand has initially grasped the deflated bladder. Once the patient's fingers are clenched about the device, the bladder is filled and expands to open the patient's hand and straighten their fingers, as represented in view 302.

Figure 4:
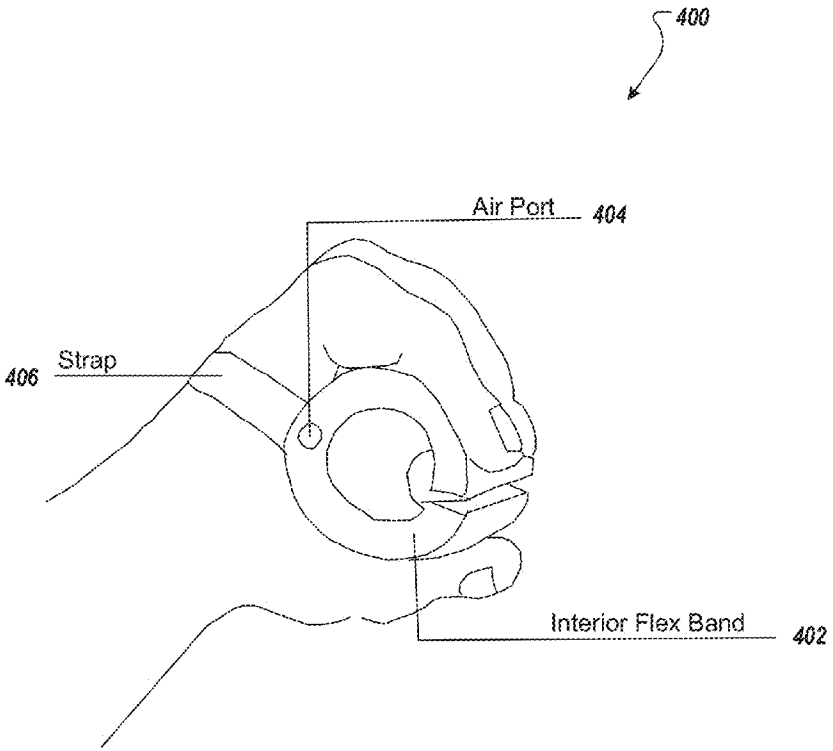

Referring to FIG. 4, another device 400 is illustrated for exercising the hand and fingers of a patient. In this example, a "c" shaped exerciser 402 is implemented that provides a hollow center rather the cylindrical-shaped exerciser shown in FIG. 1. To receive air from an air supplier (e.g., that includes a pump); the device includes a port 404 for air (or other types of fluid). To be secured to the patient's hand a strap 406 is included in the device 400; however, other techniques may be implemented to secure the device.

Figure 5:
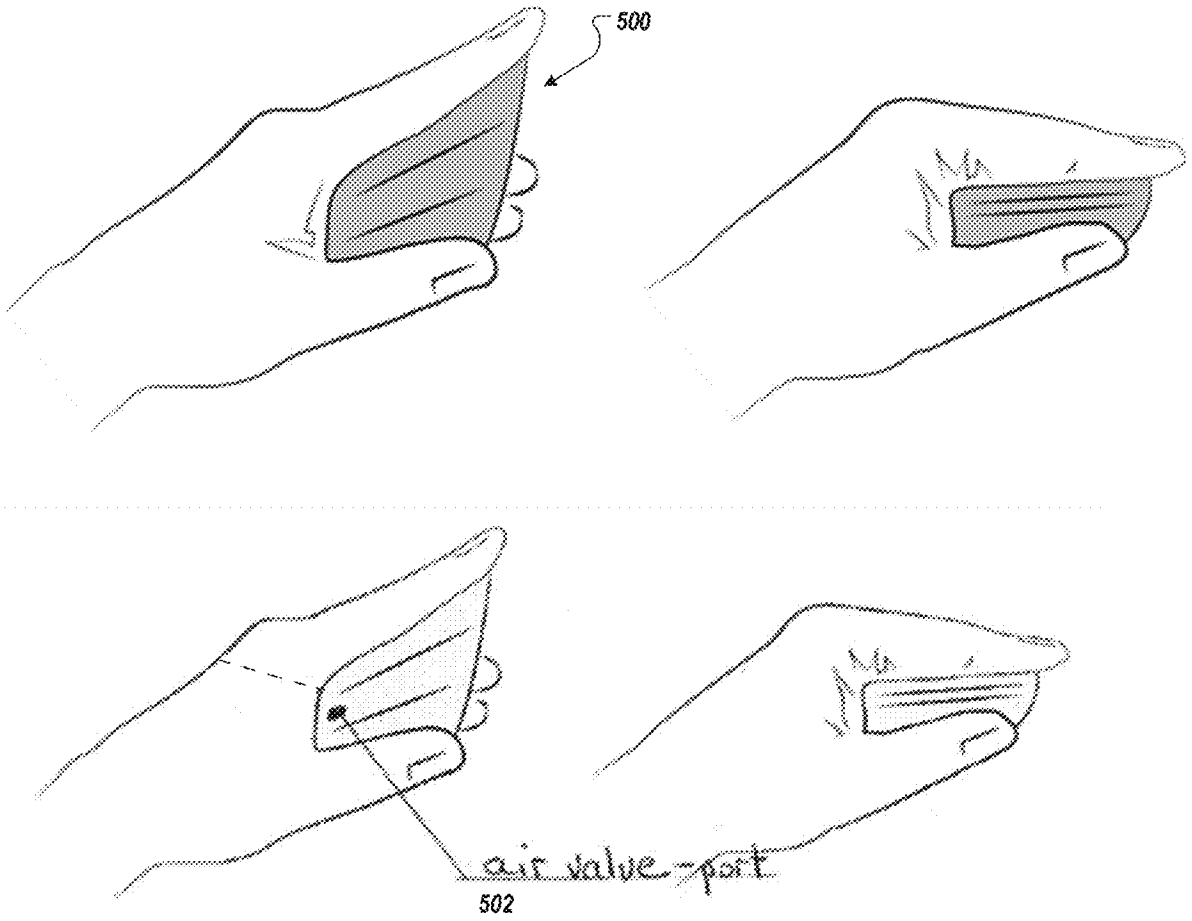

Referring to FIG. 5, another type of device 500 is illustrated for exercising the hand and fingers of a patient. Similar to other implementations, a bladder is expanded and/or contracted by air (or other type of fluid) provided by a pump or other type of air supplying device. One or more sensors, e.g., position sensors, pressure sensors, accelerometers, etc. may be used to gather information related to performed exercises and provide it for analysis, data transfer, storage, etc. at local or remote locations. Similar to the device presented in FIG. 4, an air port 502 may be included for receiving air (from an air supplier) or other types of fluid.

Along with other aspects of the device, the bladder may be designed based upon which hand and finger(s) are to be exercised. To perform an exercise, a pump device may operate manually or automatically to expand and contract the bladder, making the hand or finger(s) open and close. In some arrangements, the device 500 may also be capable of recording data that represent the progression of movement and can send this data to various recipients (e.g., healthcare providers) for a variety of applications (e.g., to be recorded in a patient's electronic medical record). For static applications, data may be recorded in an application/repair history file. One or more techniques may be employed to operate the device 500, for example, the device may inflated (e.g., using a pump) to a recommended or comfortable support level. The device may then be disconnected (from the pump), and air pressure may be released as needed.

Figure 6:
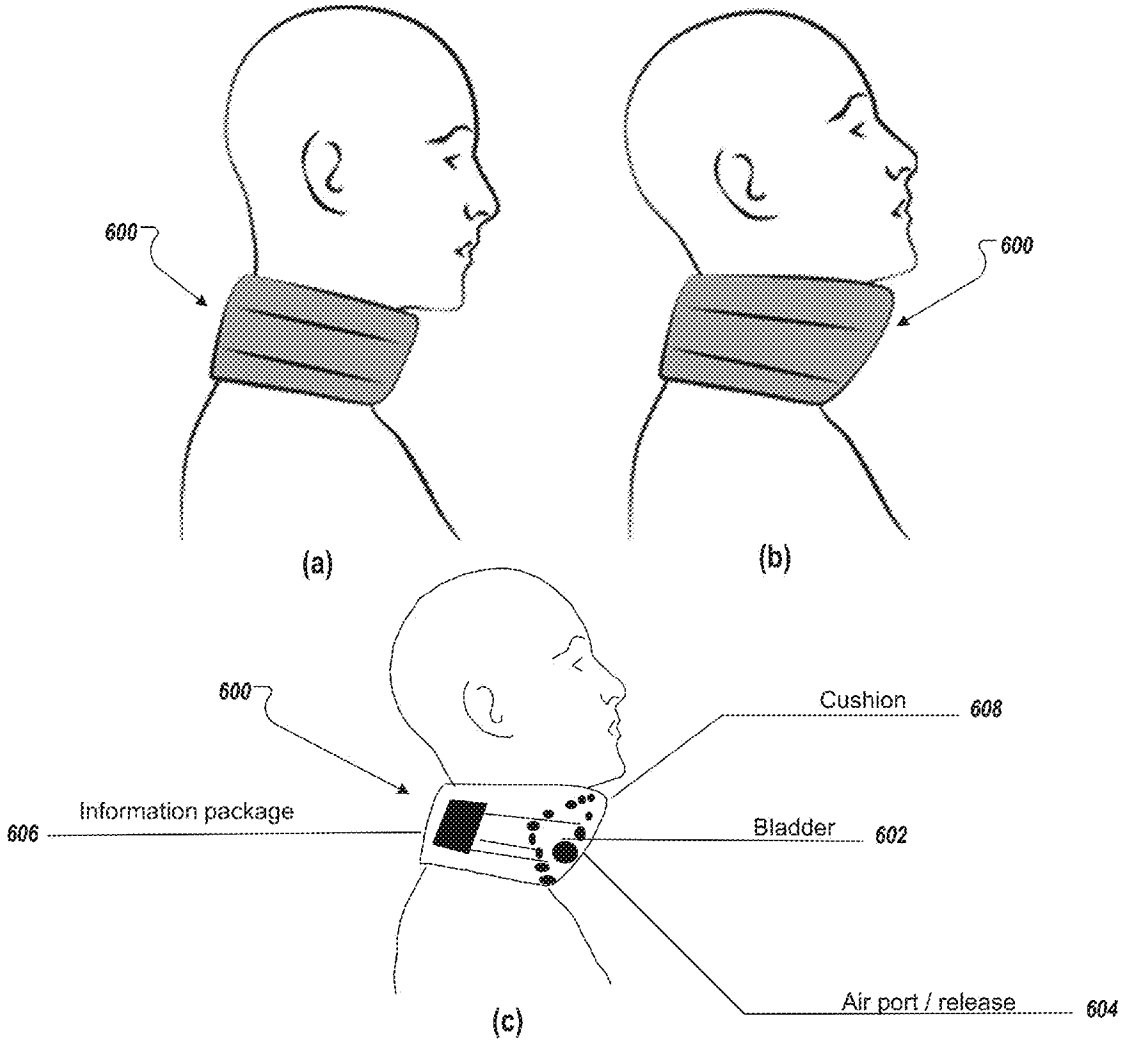
FIG. 6 illustrates a neck and jaw exercise device.

Referring to FIG. 6, a device 600 is presented that is capable of exercising the neck, jaw, etc. of an individual. As illustrated, based upon the level of inflation, the device 600 can cycle between a state in which the individual's neck is somewhat free to move (shown in FIG. 6(*a*)) to a state in which the individual's neck is restricted from movement (shown in FIG. 6(*b*)). Similar to the device shown in FIGS. 1-5, the device 600 may be inflated with an air supplier such as a pump or by employing one or more techniques. To perform an exercise, the pump (or other type of air suppler) is used to manually or automatically expand and contract a bladder, thereby making the individual's head nod up and down. Additional features of the device may include the capability to send and receive information (e.g., to and from a remote control station). For example, data representing the operations of the device 600 may be transmitted for use in applications for monitoring the individual's progress. Based upon analysis preformed, feedback information may be sent to the device 600 to appropriately adjust future exercise sessions using the device 600 (e.g., adjust inflation levels).

As represented in FIG. 6(*c*), the device 600 may include a variety of components such as a bladder 602 (or multiple bladders) that is capable of being inflated and deflated by an air supplier (e.g., a pump) connected to an air port/release 604. Along with receiving air (or other types of fluid), the air port/release 604 is also capable is releasing pressurized air (manually or in an automatically controlled manner) to deflate the bladder or bladders. An information package 606 may include hardware, software, hardware and software components for transmitting and receiving data to and from one or more remote locations. Other functionality may also be provided by the information package 606, for example, operational parameters such as the range of motion, frequency of motion (e.g., due to localized feedback), resistance, etc. (e.g., predefined and programmed into the device) may be automated. One or more energy sources (e.g., electrical batteries, etc.) may be included in the information package for powering components included in the device (e.g., wireless communication hardware, data processing equipment, etc.) included in the device 600.

In this arrangement, the device 600 employs a flexible cushion to secure the device about the individual's neck, however, other techniques may be utilized (e.g., one or more next straps). One or more heating elements (e.g., electrodes, coils, etc.), cooling elements (air cooled tubing, etc.), etc. may be incorporated into the device 500. In this arrangement, the device 600 is designed to be placed under the jaw line to the base of the neck. However, device variants may allow the exercises to be focused on other regions of the neck area of the individual. Similar to some of the previously mentioned devices, an exercise cycle may include inflating the device 600 to a recommended and/or comfortable support level, disconnecting the bladder from the air supplier (pump) and releasing air pressure as needed.

Figure 7:
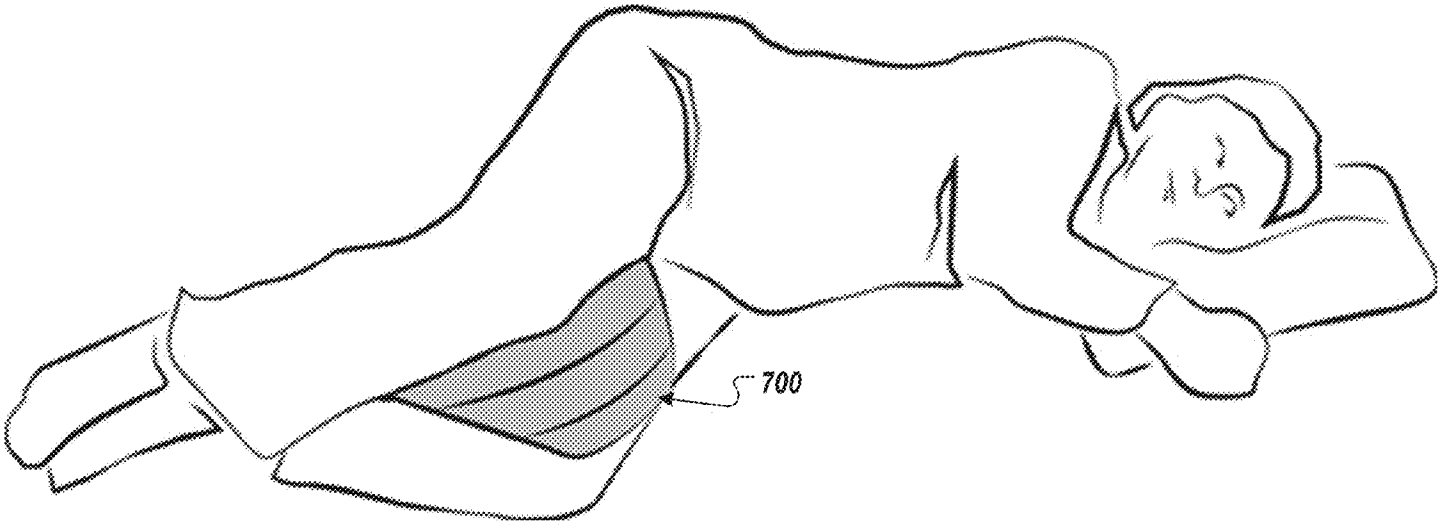
FIG. 7 illustrates a pelvic exercise device.

Referring to FIG. 7, a device 700 is presented that is capable of exercising the pelvic region of an individual. In this example, the device 700 is of the general size and shape of a pillow that includes one or more bladders that may contour to the pillow shape. Additionally the device may include a pump (not shown) or other type of air supplier. Such a device may be used for a variety of exercises, such as exercise regimens for relieving pain and pressure to lower back and pelvic area due to injury. For another application, device 700 may be used to aid sleep comfort (e.g., sciatica). For one technique, the device 700 is positioned between the upper thighs of the individual. Lying on one side, the bladder inside the pillow can be expanded and deflated for the purpose of exercise (e.g., 10" to 6"). For a sleep comfort application, a desired degree of inflation may be set to a relatively static level (e.g., three to five inches of separation between the pillow walls of the device). Similar to the other devices presented, the device 700 may include components, equipment, etc. for sending and receiving information associated with the use of the device. For example, exercise cycles may be represented by data that reflects the inflating and deflating of the device 700. Position sensors may also be included in the device 700 for measuring the level of movement during sleeping period, for measuring restless sleep patterns or other quantities. The device 700 may be implemented to a variety of geometrical shapes, sizes, etc. For example, a device may have a length on the order of ten inches, a width of ten inches and be capable of expanding to a thickness of between six to ten inches. One or more of these dimensions may be increased or decreased for producing other devices. Similarly, the size and shape of the device may be alternated in some designs. Portable form-fitting design features may be employed. For example, overlays may be produced for one or more types of mattresses (e.g., dependent upon material) and thereby account and use contour, posture, and other types of information for applications (e.g., diagnostic feedback).

Figure 8:
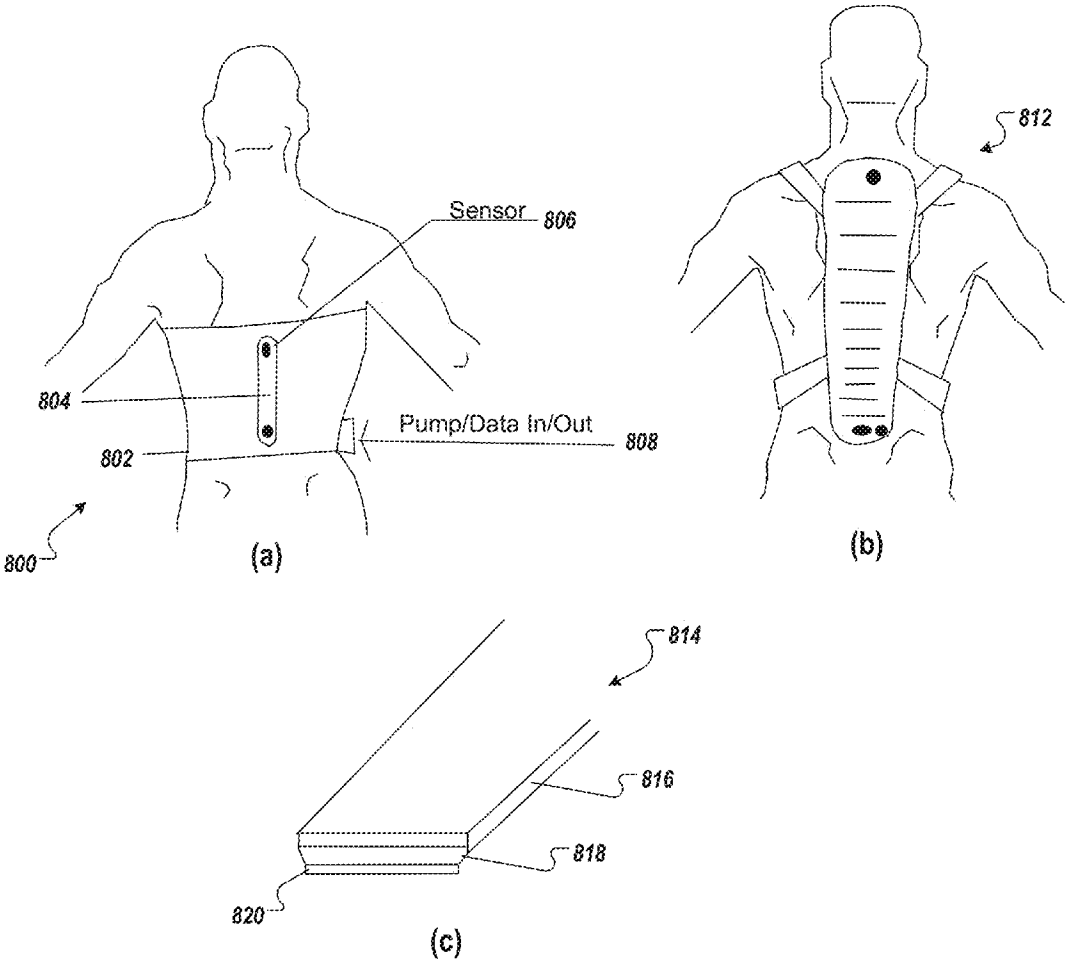
FIG. 8 illustrates a back and shoulder exercise device.

Referring to FIG. 8, devices are presented that is capable of exercising back, shoulder and other regions in this general area of an individual. Along with possible use for executing exercises to relieve back pain, the device 800 may be used to strengthen the posture of the individual. One or more design techniques may be implemented for positioning the device. For example, FIG. 8(*a*) presents a device 800 that includes a wrap 802 (e.g., of stretchable material) for supporting and positioning a bladder 804 (or multiple bladders) at a back region of the individual near the spine. In this design, the one or more sensors 806 are embedded into the wrap 802 for collecting various types of information (e.g., position information for alignment, movement information, temperature, etc.). An information package 808 may include hardware, software, hardware and software components (e.g., inclusive of thin on-device clients) for transmitting and receiving data to and from one or more remote locations. Sensing, measurements, etc. may be provided by hardware, software, combinations of hardware and software. Algorithmic analysis may also be employed, e.g., for high tolerance feedback. In one example, accurate measurement of outer boundaries can be attained for a static environment, a dynamic range of motion, etc. For such situations, such measurements may provide information for a three-dimensional (3D) output device to provide a fixed therapeutic solution or part (for a static application). In some cases, bladder motion and measurements may yields data to optimize comfort and/or fit, while the 3D device can dynamically output the resulting design. Other functionality may also be provided by the information package 808, for example, one or more energy sources (e.g., electrical batteries, etc.) may be included in the package for powering components included in the device (e.g., wireless communication hardware, data processing equipment, etc.) included in the device 800. In this example, the information package 808 also provides access to the bladder (e.g., one or more values) for receiving and releasing air or other types of fluids capable of filling the bladder.

To position the bladder upon the back of an individual, variants of the device 800 may be produced. For example, FIG. 8(*b*) presents a device 812 that employs straps to position a bladder or multiple bladders onto an individual's back. Various type of straps that employ different geometries, materials, etc. may be used for positioning the device 812 at particular locations (e.g., at the location of an injury, pain, rehabilitation needs, etc.). Similar to the other devices, a pump (not shown) or other air supplier is used to deliver fluid such as air to the bladder or bladders of the device. In general, the device 800 or 812 is inconspicuous and comfortable. In one application, the bladder may inflate automatically when the sensor 806 detects poor posture, and then deflates once posture is corrected. This information along with other information may be sent via the information package 810 to one or more recipients such as healthcare providers. Referring to FIG. 8(*c*), a variety of bladder types may be implemented, for example, a bladder 814 that has a generally plank shape of various thicknesses may be used to conform to the shape of an individual back. Layers may also be incorporated, for example, a hard skin layer 816 (e.g., ⅛ inch thick) may be followed by a bladder 818 (e.g., 3/16 inch thick) and a gel layer 820 (e.g., ⅛ inch think) that is positioned adjacent to the individual's back.

Figure 9:
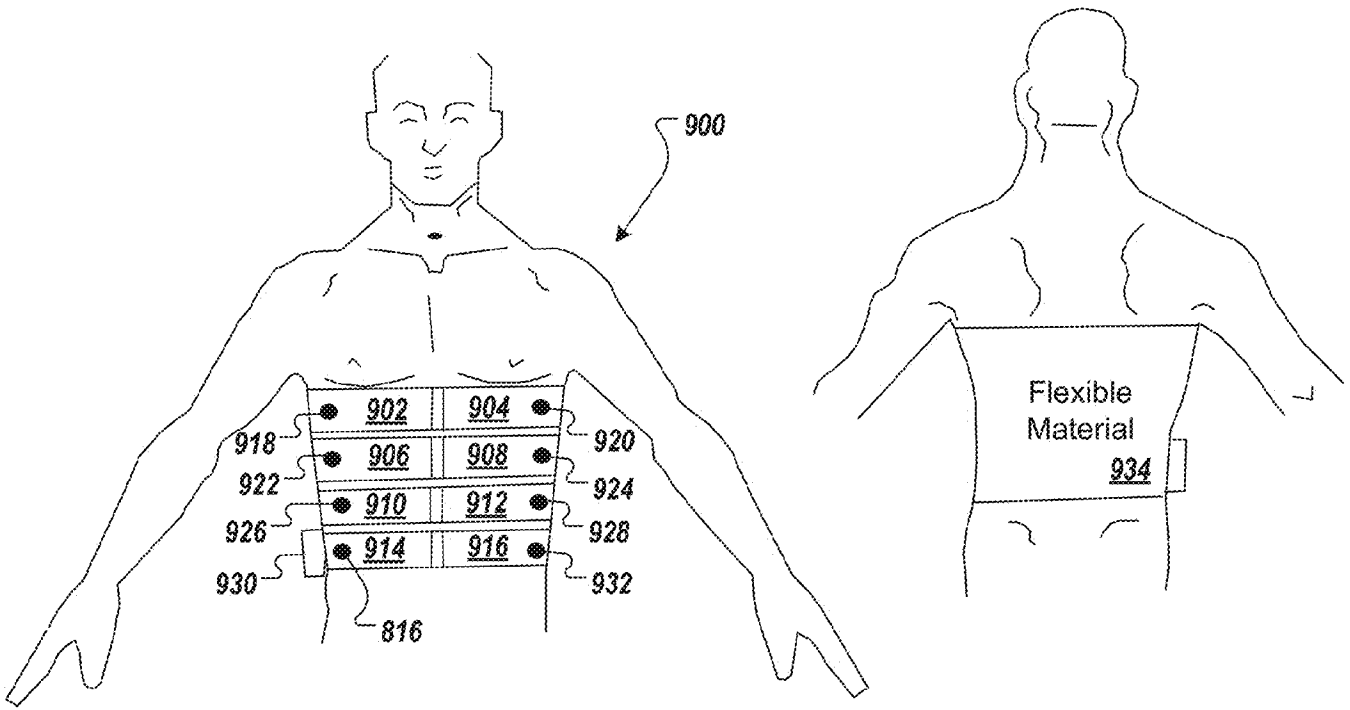
FIG. 9 illustrates an air vest or wrap.

Referring to FIG. 9, another implementation of a device is presented for assisting an individual with exercising an afflicted region of his or her body. In this implementation a device 900 includes a series of eight separated bladders 902-916 for assisting in the exercising of the individual's abdomen. While this example includes eight bladders, more or less bladders may be included in similar devices. Each bladder 902-916 may be individually inflated and deflated in this example, through the operations of a corresponding value included in a collection of values 918-932 (e.g., value 918 can control the inflating and deflating of bladder 902). Similar to the previously presented device, an information package 930 (e.g., that includes hardware, software, etc.) that is capable of providing a number of functions, including transmitting and receiving data associated with the operation of the device to and from one or more remote locations. The information package 930 may also provide one or more energy sources (e.g., electrical batteries, etc.) for powering components included in the device (e.g., wireless communication hardware, data processing equipment, valve operation, etc.), components external to the device, etc. In some arrangements, the information package 930 assists with one or more bladders receiving and releasing air or other types of fill fluids. This includes combinations of temperature and motion in simultaneous fashion.

One or more design may be implemented for producing such a wrap-based device. In this example, a flexible material 934 is employed to stretch the device 900 about the torso of the individual; however additional materials may also be employed. Further, one or more fastening techniques may be implemented to secure the device, for example, one or more Velcro straps may be used for appropriately positioning the device. Additional functionality may also be incorporated into the device, for example, one or more heating or cooling elements may be incorporated into the device. In one implementation, individually controllable heating elements may be incorporated into each bladder 902-916 for applying heat to a corresponding region of the individual's abdomen to aid healing (e.g., of a broken rib), provide treatment (e.g., after a surgical procedure), exercise (e.g., to improve posture, etc.). Similarly, a cooling element may be implemented to assist with healing (e.g., burns, sprains, etc.). During one example session of using the device 900, a pump (not shown) can be used to inflate one or more (e.g., all) of the bladders 902-916 in the wrap to provide the appropriate tightness and support in an affected area. The information package 930 may collect information (e.g., via one or more sensors included in the device) to provide a variety of information to one or more remote sited (e.g., a remotely located control station manned by healthcare professionals).

Wraps, vests, etc. (similar to the wrap used with device 900), may be used for a variety of applications. For example, for aiding individuals with disorders such as sleep disorders. As the device 900 is being worn about the torso, a pump (or other type of air supplier) may be used to apply pressure when a sensor (e.g., included in the device 900) detects a lag in breathing time, thereby assisting the individual's diaphragm to contract and the person to breathe.

In other applications, device variants may be used for assisting with the positioning of objects during procedures such as surgical procedures. For example, one or more bladders may be used to provide lift and support of various body parts, instruments, etc. during surgical procedures. In one arrangement, an air bladder of a device could be used to safely move organs, tissue and veins, for example, for creating more visibility in area of the individual being operated upon. In another example, bladders may be designed for use in a relatively small area such as the human brain. Through their use tissues, veins, etc. present in the brain may be moved during surgical procedures to create more visibility and flexibility for the surgeon, as well as a wider field of operation. On a larger scale, a variant of the device could be incorporated into the hospital bed to aid in lifting patients (e.g., inflating a flattened bladder could assist with raise numerous types of body parts). Such a device could reduce the physical strain on healthcare professionals (e.g., nurses) and thereby reduce the amount of work days lost due to injuries related to lifting and moving patients. Such devices may also be used for adjusting and supporting portions of a body such as the back, legs, arms, etc. as needed. In yet another application, such devices may be used for stimulating regions of the body. For example, the device may be used in the treatment of sexual disorders or for enhancing intimate relations (e.g., enlarging sexual orifices such as the vagina and anus, etc.). Similar to using such device with human individuals, the device or variants of the devices may be designed and produced for use with non-humans. For example, devices may be produced for use with any part of an animal's body to aid in exercise, healing treatments, etc. In one arrangement, device (including one or more air bladders) could be used as a neck collar to help train show dogs in learning correct head posture. Similarly, the device might be used to help a dog regain strength, and keep afloat while in a marine environment as the dog heals from any kind of injury, etc.

Figure 10:
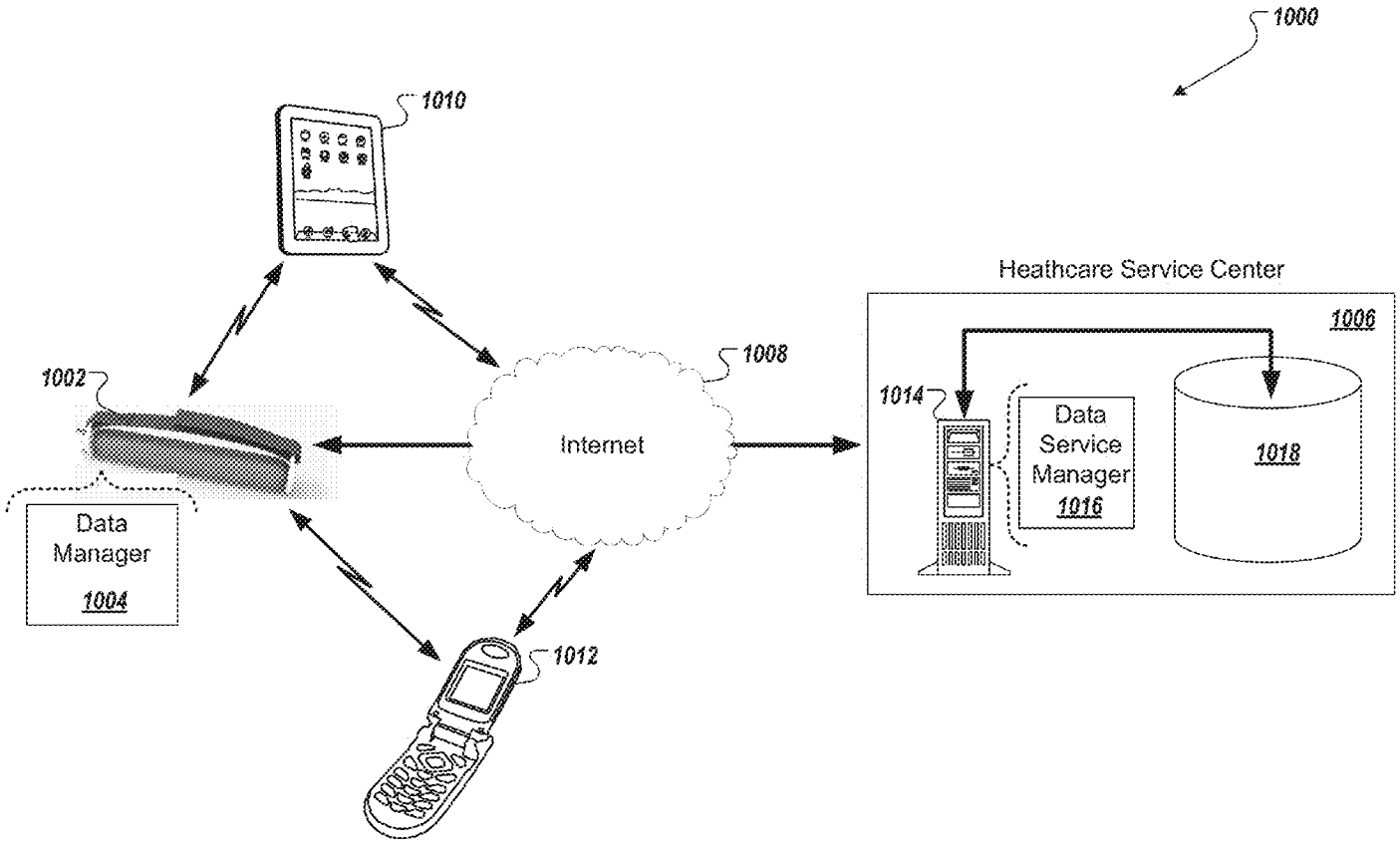
FIG. 10 illustrates a network environment for exchanging information with an exercising device.

Referring to FIG. 10, a computing environment 1000 is presented that includes a device 1002 (similar to the device 100 shown in FIG. 1) that is capable of transmitting, receiving, etc. data from one or more remote devices, locations, etc. In this example, a data manager 1004 is executed on the device 1002 (e.g., by an information package included in the device). In some arrangements, an intelligent thin client may (dependent on application) may be able to capture data, apply measurement algorithms, volume, distance to outer boundaries, 3D outlining, and range to exchange data with the device and one or more remotely located computing devices. A variety of communication techniques, protocols, application and algorithm development techniques, etc. may be employed by the device 1002 and the data manager 1004 for compiling, transmitting, receiving, analyzing data, etc. In this illustrated example, the device 1002 is capable of exchanging data with a healthcare service center 1006 (e.g., a healthcare professional's office, a hospital, an emergency service vehicle, etc.) that may be capable using data from the device (e.g., process data, analyze data, store data, etc.). One or more communication techniques (e.g., wireless communication) may be employed to send exchange data, for example, the device 1002 may be capable for directly exchanging data with the healthcare service center 1006 via one or more networks (e.g., the Internet 1008). In some arrangements one or more computing devices (e.g., executing applications) may assist in the creation, compiling, transfer of information from the device 1002 and the healthcare service center 1006, etc. For example, a tablet computing device 1010 (e.g., using an executed application or "app") or a cellular telephone 1012 (e.g., a smartphone) or other type of computing device (e.g., with wireless communication capabilities) may be used for passing data between the device and the center (e.g., by way of the Internet 1008).

Data manager 1004 may take one or more forms, such as a software agent to provide functionality that may include data creation, initial analysis, compilation, transfer, etc. Such agents can be considered a software module that is executable in a substantially autonomous manner. For example, upon being executed, a software agent may operate without considerable user interaction. By operating in a somewhat flexible manner, the software agent can adaptively address needs such as data collection, transmission, reception etc. The software agent may operate in a somewhat persistent manner, for example, the software agent may execute in a substantially continuous manner.

In this particular example, the healthcare service center 1006 may implement a variety of computing devices and equipment for interacting with the device 1002 and any potential intermediate devices (e.g., the tablet computing device 1010, the cellular telephone 1012, etc.). To provide this functionality, the healthcare service center 1006 includes a server 1014 that executes a data service manager 1016 (e.g., implemented in software, hardware, a combination of software and hardware, etc.). Along with managing data exchanges with the device 1002 along with other devices, the data service manager 1016 may also provide other functionality. For example, data collected from a device (e.g., the device 1002) may be analyzed, compiled (in a predefined manner), processed and stored by the data service manager 1016 in one or more storage devices (e.g., a storage device 1018) located at the healthcare service center 1006, at one or more sites external to the center or both.

Figure 11:
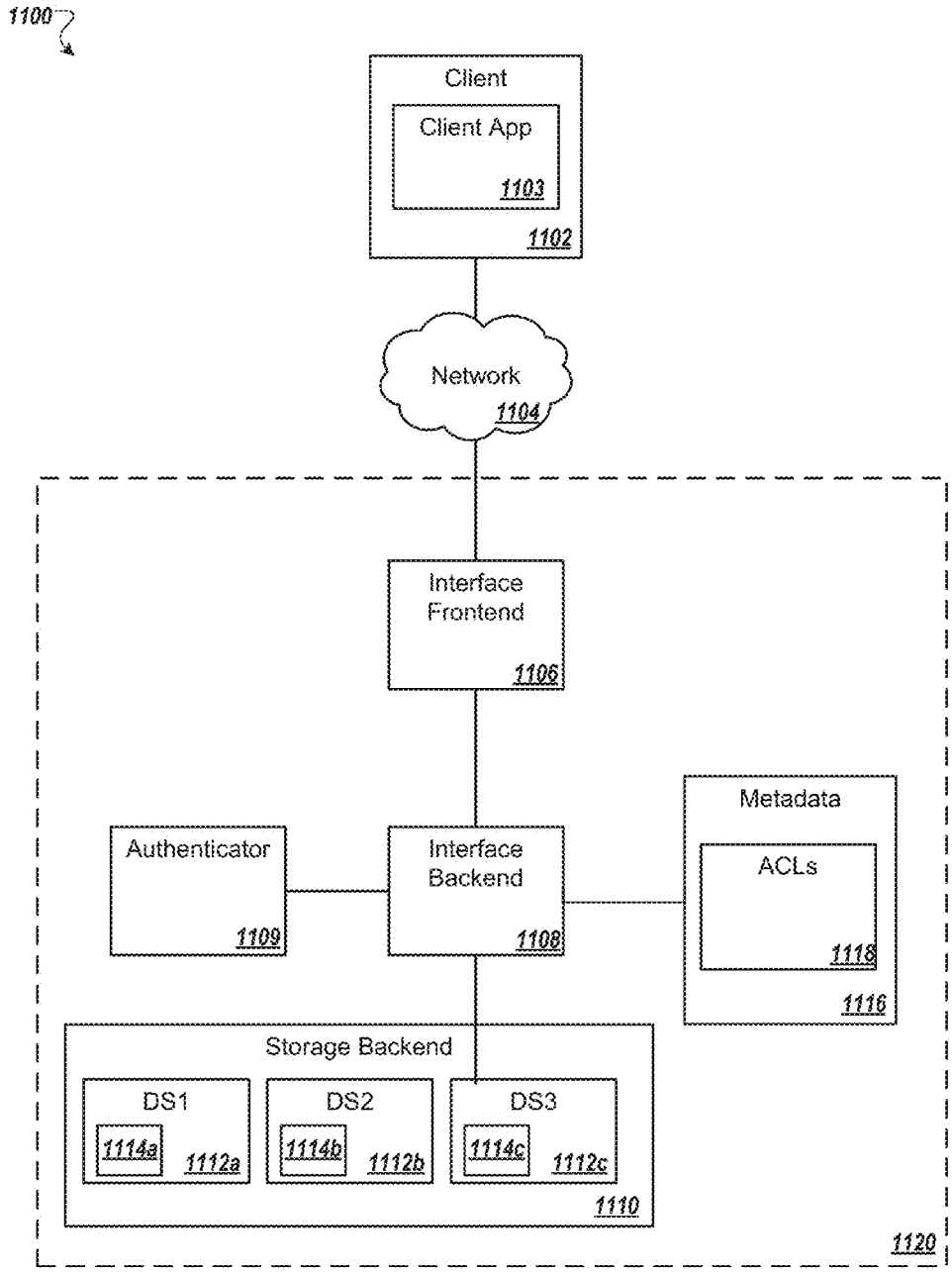
FIG. 11 is a block diagram showing an example of a system for providing hosted storage and accessing the hosted storage from a device such as a client device.

FIG. 11 is a block diagram showing an example of a system 1100 for providing hosted storage and accessing the hosted storage from a client device 1102 such as the device 1002 (shown in FIG. 10), a computing device (e.g., the tablet computing device 1010 also shown in FIG. 10). In some implementations, a hosted storage service 1120 may provide access to data (e.g., collected data from the device 1002, device commands, etc.), analyzed, compiled, stored, etc. by applications (e.g., the data manager 1004) running on devices (e.g., the device 1002), computing devices, etc. operating separately from one another, provide offsite data backup (functional replication) and restore functionality, provide data storage to a computing device with limited storage capabilities, and/or provide storage functionality not implemented on a computing device.

The system 1100 may provide scalable stores for storing data resources. The client device 1102 may upload data resources to the hosted storage service 1120 and control access to the uploaded data resources. Access control may include a range of sharing levels (e.g., private, shared with one or more individuals, shared with one or more groups, public, etc.). Data stored in hosted storage service 1120 can be secured from unauthorized access. The hosted storage service 1120 can use a simple and consistent application programming interface, or API, which can allow arbitrary quantities of structured or unstructured data to be kept private or shared between individuals, organizations, or with the world at large. The client device 1102 may access, retrieve, be provided, store, etc. data in the hosted storage service 1120 for any number of a variety of reasons. For example, data may be stored for business reasons (e.g., provide identification information to attain access clearance for device data, commands, etc. at the hosted storage service 1120), or for use in data processing by other services or historic analysis.

Figure 12:
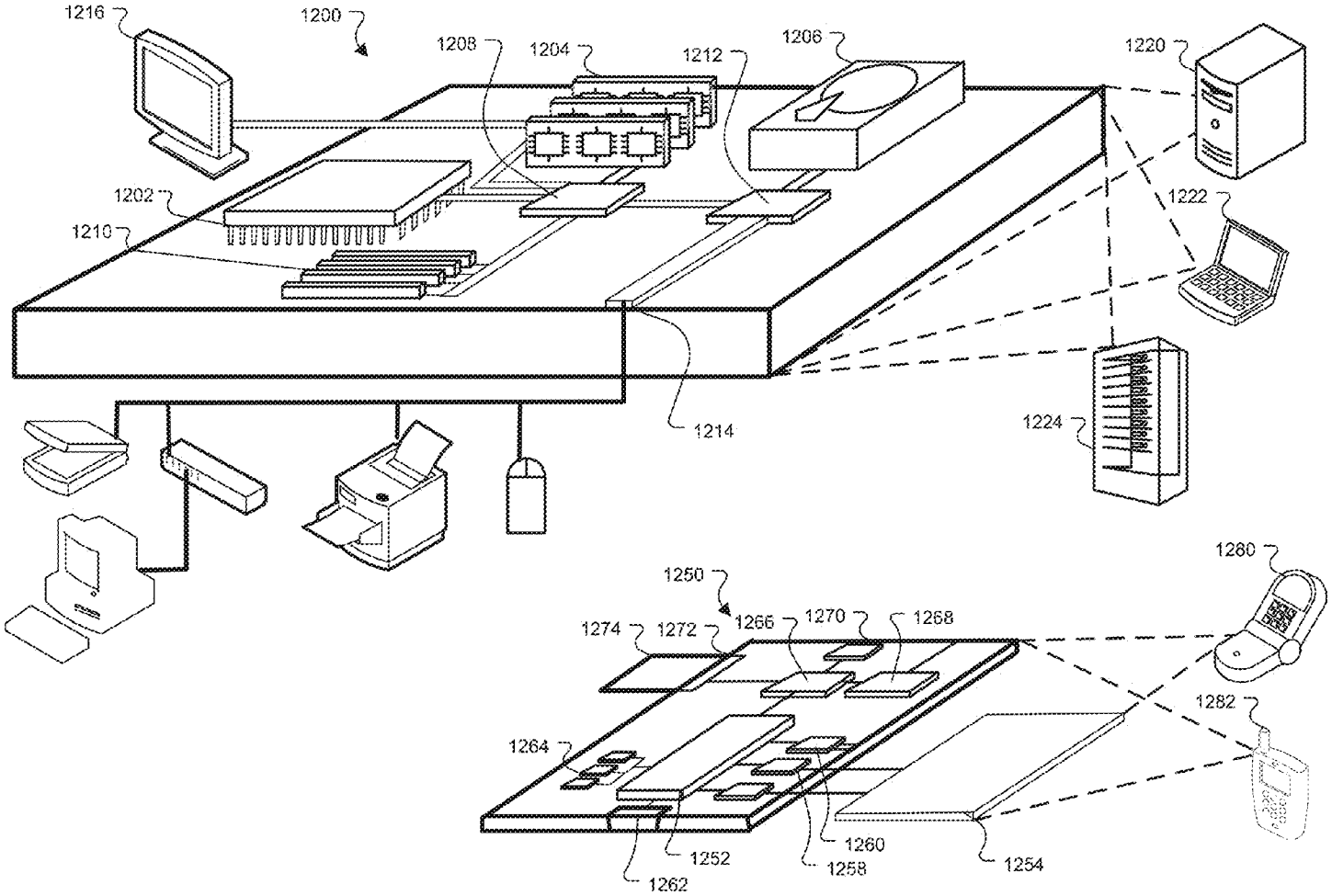
FIG. 12 illustrates an example of a computing device and a mobile computing device that can be used to implement the techniques described here.

The client device 1102 may be implemented using a computing device, such as the computing device 1200 or the mobile device 1250 described with respect to FIG. 12. The client device 1102 may communicate with the hosted storage service 1120 via a network 1104, such as the Internet. The client device 1102 may communicate across the network using communication protocols such as one or more of Transmission Control Protocol/Internet Protocol (TCP/IP), Hypertext Transfer Protocol (HTTP), Secure Shell Remote Protocol (SSH), or Application Program Interfaces (API). Electronic mail (e-mail) protocols may also be utilized. For example, one or more e-mail protocols may be used for providing information (e.g., data, commands, etc.) to a device (e.g., the device 1002) from the hosted storage service 1120, a computing device such as the computing device 1200 or the mobile device 1250, etc. While only a single client device 1102 is shown, there may be multiple client devices communicating across the network 1104 with the hosted storage service 1120 and/or other services and devices.

The hosted storage service 1120 may be implemented such that client applications executed on client device 1102, such as a client application 1103, may store, retrieve, or otherwise manipulate data resources in the hosted storage service 1120. The hosted storage service 1120 may be implemented by one or more server devices, which may be implemented using a computing device, such as the computing device 1200 or mobile device 1250 described with respect to FIG. 12. For example, the hosted storage service 1120 may be implemented by multiple server devices operating in the same, or different, data centers.

The hosted storage service 1120 generally includes an interface frontend 1106, an interface backend 1108, a storage backend 1110, and metadata 1116 for resources stored in the storage backend 1110. The hosted storage service 1120 may also include an authenticator 1109 to verify that a user requesting data, commands, etc. should be provided access (e.g., based on a service subscription, rental period, etc.).

In general, the interface frontend 1106 may receive requests from and send responses to the client device 1102. For instance, the hosted storage service 1120 may be implemented as a Web Service with a corresponding set of Web Service Application Programming Interfaces (APIs). The Web Service APIs may be implemented, for example, as a Representational State Transfer (REST)-based HTTP interface or a Simple Object Access Protocol (SOAP)-based interface. Interface frontend 1106 may receive messages from the client 1102 and parse the requests into a format usable by the hosted storage service 1120, such as a remote procedure call (RPC) to an interface backend 1108. The interface frontend 1106 may write responses generated by the hosted storage service 1120 for transmission to the client 1102. In some implementations, multiple interface frontends 1106 may be implemented to support multiple access protocols, for example.

The interface frontend 1106 may include a graphical frontend, for example to display on a web browser for data access. The interface frontend 1106 may include a sub-system to enable managed uploads and downloads of large files (e.g., for functionality such as pause, resume, and recover from time-out). The interface frontend 1106 may monitor load information and update logs, for example to track and protect against denial of service (DOS) attacks.

As described above, the Web Service API may be a REST-based HTTP interface. In a REST-based interface, a data resource is accessed as a resource, uniquely named using a uniform resource identifier (URI), and the client application 1103 and service 1120 exchange representations of resource state using a defined set of operations. For example, requested actions may be represented as verbs, such as by HTTP GET, PUT, POST, HEAD, and DELETE verbs. The GET verb may be used to retrieve a resource, while the HEAD verb may be used to retrieve information about a resource without retrieving the resource itself. The DELETE verb may be used to delete a resource from the hosted storage service 1120. The PUT and POST verbs may be used to upload a resource to the service 1120. PUT requests may come from the client 1102 and contain authentication and authorization credentials and resource metadata in a header, such as an HTTP header. POST requests may be received when a client 1102 wants to upload from a web browser form. The form POST upload protocol for the hosted storage service 1120 may involve multiple form fields to provide authentication, authorization, and resource metadata. More generally, any of the API requests may include credentials for authentication and authorization, for example in a header of the request. An authorization header may be included in the REST requests, which may include an access key to identify the entity sending the request.

Alternatively, or additionally, a user may be authenticated based on credentials stored in a browser cookie, which may be appended to the API requests. If no valid cookie is present, a redirect to an authentication frontend may be generated, and the authentication frontend may be used to generate the browser cookie. The authentication frontend may be used by systems and services in addition to the hosted storage service 1120 (e.g., if the organization operating the hosted storage service 1120 also operates other web services such as email service). A user may also or alternatively be authenticated based on authentication credentials from an external credentialing service or an external service that includes credentialing functionality. User or group identifier information may be calculated from the external service's credential information. Requests sent by the client 1102 to the interface frontend 1106 may be translated and forwarded to the external service for authentication.

In general, resources stored in the hosted storage service 1120 may be referenced by resource identifiers. The hosted storage service 1120 may define namespaces to which a valid resource identifier must conform. For example, the namespace may require that resource identifiers be a sequence of Unicode characters whose UTF-8 encoding is at most 1024 bytes long. As another example, the namespace may require that resource identifiers be globally unique identifiers (GUIDs), which may be 128-bit integers.

Resources (e.g., objects such as font data) may be stored in hosted storage service 1120 in buckets. In some examples, each bucket is uniquely named in the hosted storage service 1120, each data resource is uniquely named in a bucket, and every bucket and data resource combination is unique. Data resources may be uniquely identified by a URI that includes the bucket name and the resource name, and identifies the hosted storage service 1120. Alternatively, the user of the client 1302 may create a bucket. In some examples, buckets do not nest.

The interface backend 1108 along with the authenticator 1109 may handle request authentication and authorization, manage data and metadata, and track activity, such as for billing; moreover potentially for a remote physical therapy session or remote serve call application. As one example, the interface backend 1108 may query the authenticator 1109 when a request for one or more fonts is received. The interface backend 1108 may also provide additional or alternative functionality. For example, the interface backend 1108 may provide functionality for independent frontend/backend scaling for resource utilization and responsiveness under localized heavy loads. Data management may be encapsulated in the interface backend 1108 while communication serving may be encapsulated in the interface frontend 1106. The interface backend 1108 may isolate certain security mechanisms from the client-facing interface frontend 1106.

The interface backend 1108 may expose an interface usable by both the interface frontend 1106 and other systems. In some examples, some features of the interface backend 1108 are accessible only by an interface frontend (not shown) used by the owners of the hosted storage service 1120 (internal users). Such features may include those needed for administrative tasks (e.g., resolving a resource reference to a low-level disk address), hosted therapeutic services, etc. The interface backend 1108 may handle request authentication (e.g., ensuring a user's credentials are valid) and authorization (e.g., verifying that a requested operation is permitted). The interface backend may also provide encryption and decryption services to prevent unauthorized access to data, even by internal users.

The interface backend 1108 may manage metadata 1116 associated with data resources, for example in a MySQL database. User-specified names that label the buckets can be completely defined within the metadata 1116, and resource metadata 1116 can map a resource name to one or more datastores 1112 storing the resource. The metadata 1116 can also contain bucket and resource creation times, resource sizes, hashes, and access control lists 1118 (ACL 1118) for both buckets and resources. The interface backend 1108 can log activity and track storage consumption to support accounting for billing and chargebacks. In some examples, this includes quota monitoring in each dimension in which customers are charged (e.g., reads, writes, network transfers, total storage in use).

The ACLs 1118 may generally define who is authorized to perform actions on corresponding buckets or resources, and the nature of the permitted actions. The ACLs 1118 may be an unordered list of {scope, role} pairs, plus Boolean flags. The scope may define a user or group of users and the role may define the access permissions for the user or group. In some examples, the union of all {scope, role} pairs may define access rights. In some examples, more specific {scope, role} pairs override more general ones.

The storage backend 1110 may contain multiple datastores 1112*a*-1112*c*. Although three datastores 1112 are shown, more or fewer are possible. Each of the datastores 1112*a*-1112*c* may store data resources 1114*a*-1114*c* in a particular format. For example, data store 1112*a* may store a data resource 1114*a* as a binary object, data store 1112*b* may store a data resource 1114*b* in a distributed file system (e.g., Network File System), and data store 1112*c* may store a data resource 1114*c* in a database.

FIG. 12 shows an example of example computer device 1200 and example mobile computer device 1250, which can be used to implement the techniques described herein. For example, a portion or all of the operations of the data manager 1104 (shown in FIG. 10), the data service manager 1016 (also shown in FIG. 10), assisting with data transfers to and from a device (e.g., device 1002 also shown in FIG. 10), may be executed by the computer device 1200 and/or the mobile computer device 1450. Computing device 1200 is intended to represent various forms of digital computers, including, e.g., laptops, desktops, workstations, personal digital assistants, servers, blade servers, mainframes, and other appropriate computers. Computing device 1250 is intended to represent various forms of mobile devices, including, e.g., personal digital assistants, tablet computing devices, cellular telephones, smartphones, and other similar computing devices. The components shown here, their connections and relationships, and their functions, are meant to be examples only, and are not meant to limit implementations of the techniques described and/or claimed in this document.

Computing device 1200 includes processor 1202, memory 1204, storage device 1206, high-speed interface 1208 connecting to memory 1204 and high-speed expansion ports 1210, and low speed interface 1212 connecting to low speed bus 1214 and storage device 1206. Each of components 1202, 1204, 1206, 1208, 1210, and 1212, are interconnected using various busses, and can be mounted on a common motherboard or in other manners as appropriate. Processor 1202 can process instructions for execution within computing device 1200, including instructions stored in memory 1204 or on storage device 1206 to display graphical data for a GUI on an external input/output device, including, e.g., display 1216 coupled to high speed interface 1208. In other implementations, multiple processors and/or multiple busses can be used, as appropriate, along with multiple memories and types of memory. Also, multiple computing devices 1200 can be connected, with each device providing portions of the necessary operations (e.g., as a server bank, a group of blade servers, or a multi-processor system).

Memory 1204 stores data within computing device 1200. In one implementation, memory 1204 is a volatile memory unit or units. In another implementation, memory 1204 is a non-volatile memory unit or units. Memory 1204 also can be another form of computer-readable medium (e.g., a magnetic or optical disk. Memory 1204 may be non-transitory.)

Storage device 1206 is capable of providing mass storage for computing device 1200. In one implementation, storage device 1206 can be or contain a computer-readable medium (e.g., a floppy disk device, a hard disk device, an optical disk device, or a tape device, a flash memory or other similar solid state memory device, or an array of devices, such as devices in a storage area network or other configurations.) A computer program product can be tangibly embodied in a data carrier. The computer program product also can contain instructions that, when executed, perform one or more methods (e.g., those described above.) The data carrier is a computer- or machine-readable medium, (e.g., memory 1204, storage device 1206, memory on processor 1202, and the like.)

High-speed controller 1208 manages bandwidth-intensive operations for computing device 1200, while low speed controller 1212 manages lower bandwidth-intensive operations. Such allocation of functions is an example only. In one implementation, high-speed controller 1208 is coupled to memory 1204, display 1216 (e.g., through a graphics processor or accelerator), and to high-speed expansion ports 1210, which can accept various expansion cards (not shown). In the implementation, low-speed controller 1212 is coupled to storage device 1206 and low-speed expansion port 1214. The low-speed expansion port, which can include various communication ports (e.g., USB, Bluetooth®, Ethernet, wireless Ethernet), can be coupled to one or more input/output devices, (e.g., a keyboard, a pointing device, a scanner, or a networking device including a switch or router, e.g., through a network adapter.)

Computing device 1200 can be implemented in a number of different forms, as shown in the figure. For example, it can be implemented as standard server 1220, or multiple times in a group of such servers. It also can be implemented as part of rack server system 1224. In addition or as an alternative, it can be implemented in a personal computer (e.g., laptop computer 1222.) In some examples, components from computing device 1200 can be combined with other components in a mobile device (not shown), e.g., device 1250. Each of such devices can contain one or more of computing device 1200, 1250, and an entire system can be made up of multiple computing devices 1200, 1250 communicating with each other.

Computing device 1250 includes processor 1252, memory 1264, an input/output device (e.g., display 1254, communication interface 1266, and transceiver 1268) among other components. Device 1250 also can be provided with a storage device, (e.g., a microdrive or other device) to provide additional storage. Each of components 1250, 1252, 1264, 1254, 1266, and 1268, are interconnected using various buses, and several of the components can be mounted on a common motherboard or in other manners as appropriate.

Processor 1252 can execute instructions within computing device 1250, including instructions stored in memory 1264. The processor can be implemented as a chipset of chips that include separate and multiple analog and digital processors. The processor can provide, for example, for coordination of the other components of device 1250, e.g., control of user interfaces, applications run by device 1250, and wireless communication by device 1250.

Processor 1252 can communicate with a user through control interface 1258 and display interface 1256 coupled to display 1254. Display 1254 can be, for example, a TFT LCD (Thin-Film-Transistor Liquid Crystal Display) or an OLED (Organic Light Emitting Diode) display, or other appropriate display technology. Display interface 1256 can comprise appropriate circuitry for driving display 1254 to present graphical and other data to a user. Control interface 1258 can receive commands from a user and convert them for submission to processor 1252. In addition, external interface 1262 can communicate with processor 1242, so as to enable near area communication of device 1250 with other devices. External interface 1262 can provide, for example, for wired communication in some implementations, or for wireless communication in other implementations, and multiple interfaces also can be used.

Memory 1264 stores data within computing device 1250. Memory 1264 can be implemented as one or more of a computer-readable medium or media, a volatile memory unit or units, or a non-volatile memory unit or units. Expansion memory 1274 also can be provided and connected to device 1250 through expansion interface 1272, which can include, for example, a SIMM (Single In Line Memory Module) card interface. Such expansion memory 1274 can provide extra storage space for device 1250, or also can store applications or other data for device 1250. Specifically, expansion memory 1274 can include instructions to carry out or supplement the processes described above, and can include secure data also. Thus, for example, expansion memory 1274 can be provided as a security module for device 1250, and can be programmed with instructions that permit secure use of device 1250. In addition, secure applications can be provided through the SIMM cards, along with additional data, (e.g., placing identifying data on the SIMM card in a non-hackable manner.)

The memory can include, for example, flash memory and/or NVRAM memory, as discussed below. In one implementation, a computer program product is tangibly embodied in a data carrier. The computer program product contains instructions that, when executed, perform one or more methods, e.g., those described above. The data carrier is a computer- or machine-readable medium (e.g., memory 1264, expansion memory 1274, and/or memory on processor 1252), which can be received, for example, over transceiver 1268 or external interface 1262.

Device 1250 can communicate wirelessly through communication interface 1266, which can include digital signal processing circuitry where necessary. Communication interface 1266 can provide for communications under various modes or protocols (e.g., GSM voice calls, SMS, EMS, or MMS messaging, CDMA, TDMA, PDC, WCDMA, CDMA2000, or GPRS, among others.) Such communication can occur, for example, through radio-frequency transceiver 1268. In addition, short-range communication can occur, e.g., using a Bluetooth®, WiFi, or other such transceiver (not shown). In addition, GPS (Global Positioning System) receiver module 1270 can provide additional navigation- and location-related wireless data to device 1250, which can be used as appropriate by applications running on device 1250. Sensors and modules such as cameras, microphones, compasses, accelerators (for orientation sensing), etc. may be included in the device.

Device 1250 also can communicate audibly using audio codec 1260, which can receive spoken data from a user and convert it to usable digital data. This provides the capability for "speech to text" and "text to speech" applications for remote onsite feedback and situational reporting of progress or onsite visual observation, as well as written prescribed routine that can be received remotely in audible form. Audio codec 1260 can likewise generate audible sound for a user, (e.g., through a speaker in a handset of device 1250.) Such sound can include sound from voice telephone calls, can include recorded sound (e.g., voice messages, music files, and the like) and also can include sound generated by applications operating on device 1250.

Computing device 1250 can be implemented in a number of different forms, as shown in the figure. For example, it can be implemented as cellular telephone 1280. It also can be implemented as part of smartphone 1282, personal digital assistant, or other similar mobile device.

Various implementations of the systems and techniques described here can be realized in digital electronic circuitry, integrated circuitry, specially designed and programmed ASICs (application specific integrated circuits), computer hardware, firmware, software, and/or combinations thereof. These various implementations can include implementation in one or more computer programs that are executable and/or interpretable on a programmable system including at least one programmable processor. The programmable processor can be special or general purpose, coupled to receive data and instructions from, and to transmit data and instructions to, a storage system, at least one input device, and at least one output device (e.g., a 3D output device).

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to a computer program product, apparatus and/or device (e.g., magnetic discs, optical disks, memory, Programmable Logic Devices (PLDs)) used to provide machine instructions and/or data to a programmable processor, including a machine-readable medium that receives machine instructions.

To provide for interaction with a user, the systems and techniques described here can be implemented on a computer having a device for displaying data to the user (e.g., a CRT (cathode ray tube) or LCD (liquid crystal display) monitor), and a keyboard and a pointing device (e.g., a mouse or a trackball) by which the user can provide input to the computer. Other kinds of devices can be used to provide for interaction with a user as well; for example, feedback provided to the user can be a form of sensory feedback (e.g., visual feedback, auditory feedback, or tactile feedback); and input from the user can be received in a form, including acoustic, speech, or tactile input.

The systems and techniques described here can be implemented in a computing system that includes a backend component (e.g., as a data server), or that includes a middleware component (e.g., an application server), or that includes a frontend component (e.g., a client computer, executed application, etc. having a user interface or a Web browser through which a user can interact with an implementation of the systems and techniques described here), or a combination of such back end, middleware, or frontend components. The components of the system can be interconnected by a form or medium of digital data communication (e.g., a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

In some implementations, the engines described herein can be separated, combined or incorporated into a single or combined engine. The engines depicted in the figures are not intended to limit the systems described here to the software architectures shown in the figures.

Figure 13:
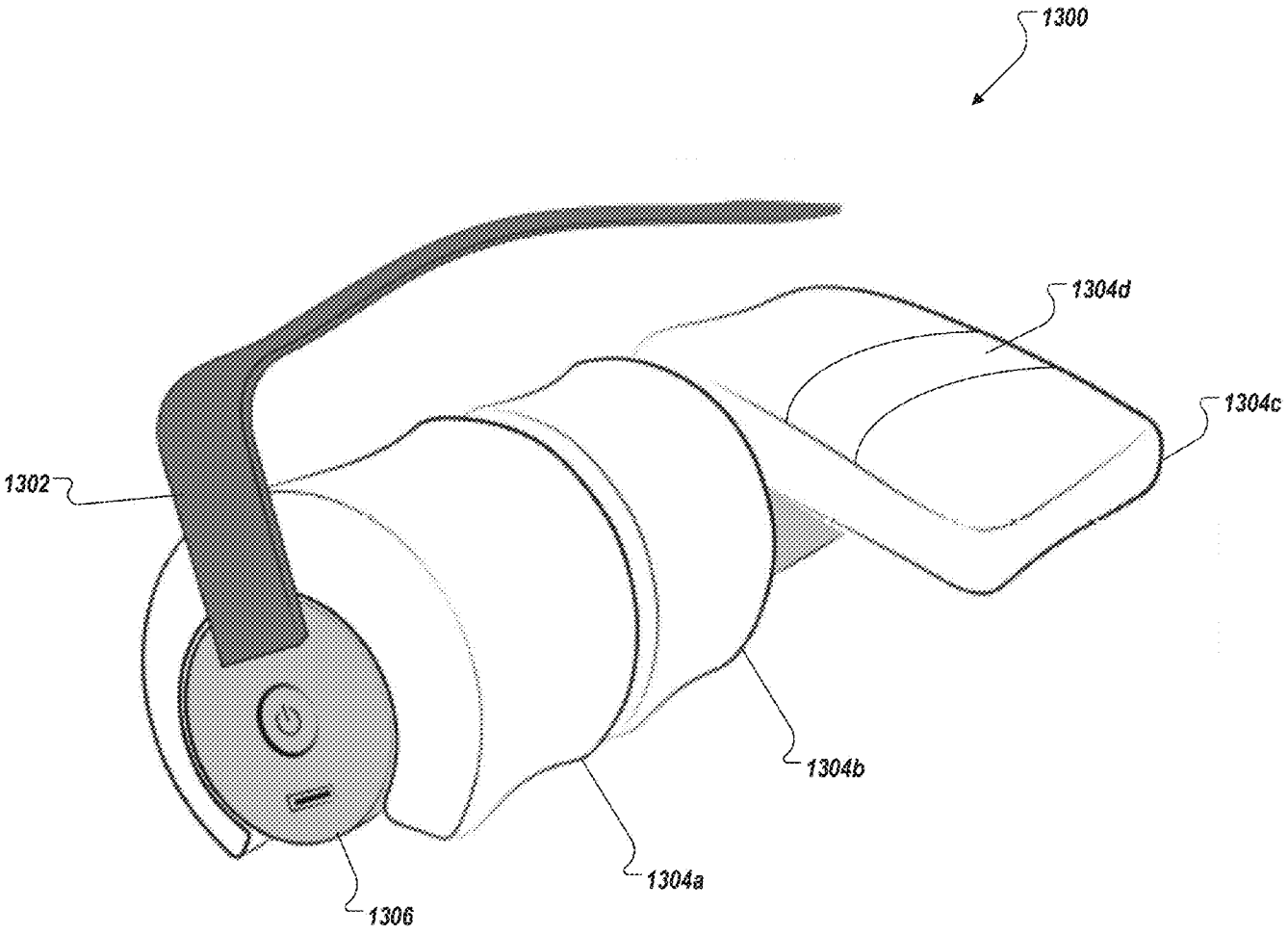
FIG. 13 illustrates a finger exercise device.

Referring to FIG. 13, other types of designs and functionality may be incorporated into exercising devices. For example, as illustrated in the figure, an individual finger exercising device 1300 is capable of controlling the extending of individual fingers. Additionally, multiple capabilities are incorporated into the exercising device (e.g., an integrated self-contained pump mechanism). In general, the exercising device 1300 can communicate to an application being executed on one or more computing devices (e.g., a smart phone, computer system, tablet computing device, etc.) or as a stand-alone dedicated device through one or more protocols (e.g., a wireless protocols such as Bluetooth™, Wifi™, etc. In some arrangements, the application can be considered as a thin application client or program that depends upon a separate computing device to fulfill its computational role(s). The exercising device 1300 may be controlled (e.g., by a user, healthcare professional, etc.) through the executed application. In this particular design, the exercising device 1300 includes a flexible hand strap 1302 to stabilize the device during periods of exercise. Multiple bladders 1304*a-c* are included in the device and may be ergonomically contoured to the fingers of the user. For demonstrative purposes, inflatable bladder 1304*c* is illustrated as being individually extended—and to accept one or two fingers (compared to the positions of bladders 1304*a* and 1304*b*). FIG. 13 also illustrates a strap 1304*d* to assist in holding a finger or fingers in place when exercising to a closed position. In some arrangements, multiple straps, pockets, etc. may be employed to provide such functionality. Such a capability may be considered important for individuals who suffer from an injury, affliction, etc. wherein they have difficulty forming a first with their fingers, bending individual fingers, etc. The exercising device 1300 also includes an information package 1306 that provides functionality such as a connection to charge the device (e.g., a micro USB) and transfer data (e.g., when wireless data transfer is not active or provided by the information package 1308). Along with providing communication capabilities (e.g., data transfer functionality), the information package 1306 also includes a self-contained pump and corresponding control circuitry for controlling the inflating and deflating of the respective bladders 1304*a-c*.

A number of embodiments have been described. Nevertheless, it will be understood that various modifications can be made without departing from the spirit and scope of the processes and techniques described herein. In addition, the logic flows depicted in the figures do not require the particular order shown, or sequential order, to achieve desirable results. In addition, other steps can be provided, or steps can be eliminated, from the described flows, and other components can be added to, or removed from, the described systems. Accordingly, other embodiments are within the scope of the following claims.

What is claimed is:

1. A system, comprising:

a device including:

one or more bladders capable of being inflated and deflated, each of the one or more bladders being contoured to be received by a palm of an individual's hand, and, each of the one or more bladders including a water resistant material;

a removable sleeve for fitting over one or more of the bladders; and a safety release valve to regulate the pressure of the air within the one or more bladders;

a pump connected to the device to provide air for inflating the one or more bladders, wherein the pump is separable from the device, and a pressure gauge and an air release valve are connected to the pump; a heat controller to control the operating temperature of the device and an information package capable of providing instructions from a healthcare worker to the device for inflating and deflating the one or more bladders, the information package also being capable of processing data representing the inflating and deflating of the one or more bladders and reporting the processed data to the healthcare worker.

2. The system of claim 1, wherein the one or more bladders are capable of being inflated and deflated in a repetitive manner for exercising phalanges.

3. The system of claim 1, wherein the system includes one or more components for controlling the inflating and deflating of the one or more bladders.

4. The system of claim 3, wherein the one or more components for controlling the inflating and deflating of the one or more bladders are located remote from the device.

5. The system of claim 3, wherein the one or more components for controlling the inflating and deflating of the one or more bladders are located near the device.

6. The system of claim 1, wherein the one or more bladders are fluid filled.

7. The system of claim 1, wherein the system includes one or more communication components capable of transmitting data from the information package to a remote location.

* * * * *